US006491068B1

(12) United States Patent
Markward et al.

(10) Patent No.: US 6,491,068 B1
(45) Date of Patent: Dec. 10, 2002

(54) APPARATUS FOR HEATING LUBRICATING OIL IN A WEAVING MACHINE

(75) Inventors: Dietmar Markward, Rüti; Erich Gasser, Wiesendangen, both of (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 09/569,759

(22) Filed: May 12, 2000

(30) Foreign Application Priority Data

May 31, 1999 (DE) ..... 199 24 998

(51) Int. Cl.[7] ..... D03D 41/00

(52) U.S. Cl. ..... 139/1 R; 139/11; 139/45; 139/438

(58) Field of Search ..... 139/1 R, 11, 45, 139/438; 184/104.1, 55.1, 6; 236/68 C, 91 R

(56) References Cited

U.S. PATENT DOCUMENTS 3,729,064 A * 4/1973 Wolf et al. ..... 184/6.14
4,066,869 A * 1/1978 Apaloo et al. ..... 219/490
4,105,093 A * 8/1978 Dickinson ..... 184/6.11
4,444,292 A * 4/1984 Brown et al. ..... 184/6
4,512,300 A * 4/1985 DeVore et al. ..... 123/196 AB
4,520,848 A * 6/1985 Lucian et al. ..... 139/1 R
4,587,912 A * 5/1986 Wolff et al. ..... 112/256
4,635,684 A * 1/1987 Hintsch ..... 139/1 R
4,693,282 A * 9/1987 Campbell ..... 139/1 R
5,236,063 A * 8/1993 Nelson et al. ..... 184/3.2
5,291,970 A * 3/1994 Vinciguerra et al. ..... 184/11.2
5,620,060 A * 4/1997 Bialke ..... 184/104.1
5,784,531 A * 7/1998 Mann et al. ..... 392/494

FOREIGN PATENT DOCUMENTS

DE 19924998 * 5/1999 ..... D03J/1/00

* cited by examiner

*Primary Examiner*—A. Vanatta
*Assistant Examiner*—Robert H. Muromoto, Jr.
(74) *Attorney, Agent, or Firm*—Townsend and Townsend and Crew LLP

(57) ABSTRACT

An apparatus for the heating of a lubricating oil for a weaving machine contains at least one heating element with at least one semiconductor and temperature regulator with a sensor.

7 Claims, 6 Drawing Sheets

APPARATUS FOR HEATING LUBRICATING OIL IN A WEAVING MACHINE

The invention relates to an apparatus for the heating of lubricating oil present in a container and to an apparatus for the lubrication of a plurality of lubricating points as well as to a weaving machine with such an apparatus.

In, for example, projectile weaving machines, pulsed lubrication is, as a rule, provided in order to supply different lubricating points with lubricating oil mist. For this purpose an apparatus is used which has a container, a mist generator, a distributor for supplying the oil mist to the lubricating points and an electrical heating element for the heating up of the lubricating oil. The heating element is a PTC-element with self-regulation, which has a predetermined reference temperature and which stands in contact with the lubricating oil in order to preheat a small quantity of lubricating oil.

If the PTC-element is used for heating purposes, then the disadvantages result in that during heating up the resistance increases and thereby the power is reduced, that a precise regulation is not possible due to the temperature dependency with heat dissipation by the lubricating oil, and in that the heating power is restricted.

The invention is based on the object of improving an apparatus for the heating up of lubricating oil.

This object is satisfied in accordance with the invention by the characterising features of claim 1.

The advantages which can be achieved with the invention are essentially to be seen in the higher and selectable heating power and a precise regulation of the temperature. Furthermore, weaving machines can be simply converted.

Advantageous embodiments result from the dependent claims.

An apparatus for the lubrication of a plurality of lubricating points with a container for the lubricating oil and with an apparatus for the heating up of lubricating oil present in the container is characterised in accordance with the invention by the features of claim 7.

The advantages which can be achieved with the apparatus are to be seen in the short heating up phase for the lubricating oil and, as a result of this, the short start up time for the weaving machine, the improved lubrication and the thereby possible higher performance of the weaving machine.

The invention will be explained in the following with reference to the accompanying drawings.

Figure 1:
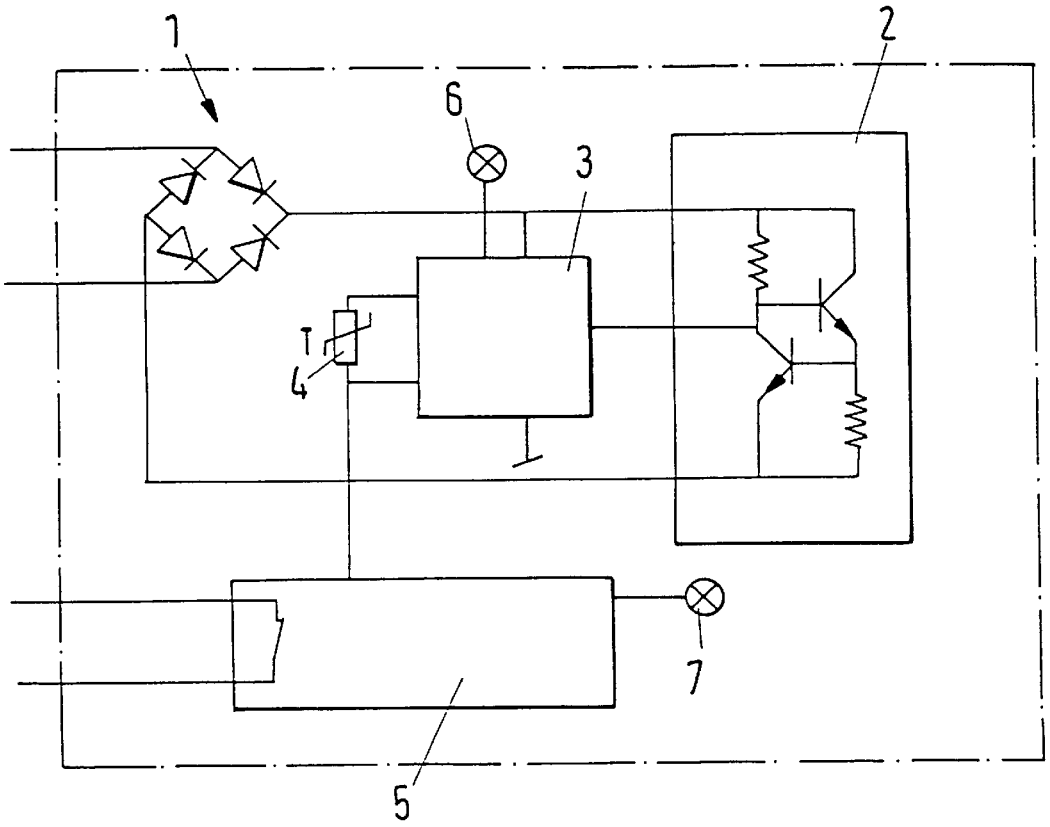
Figure 2:
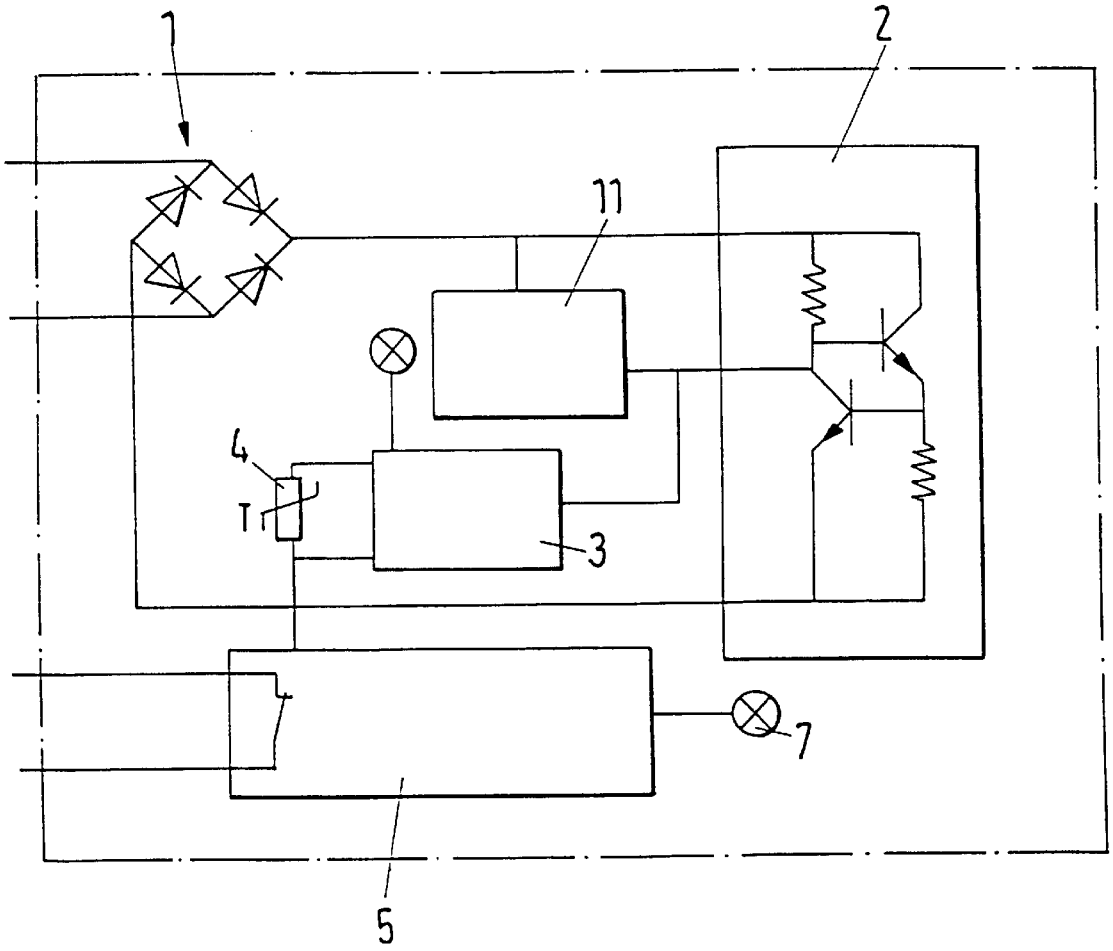
Figure 3:
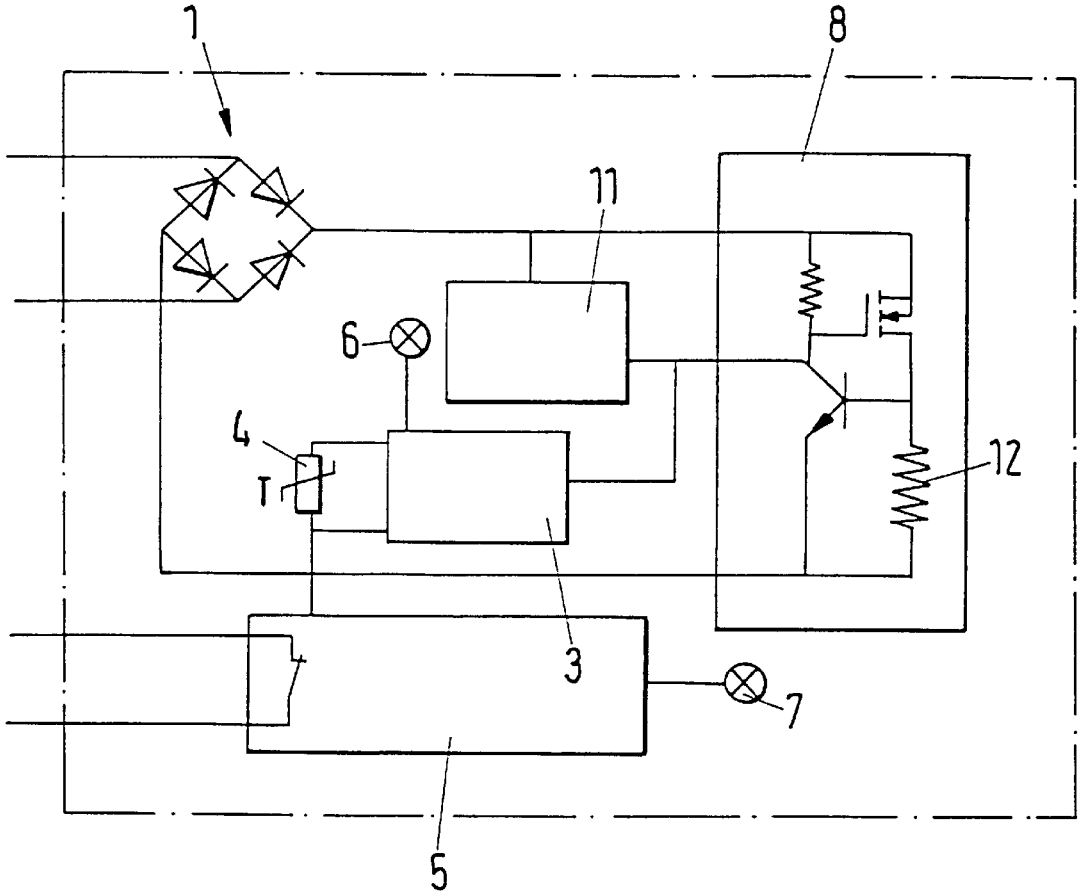
Figure 4:
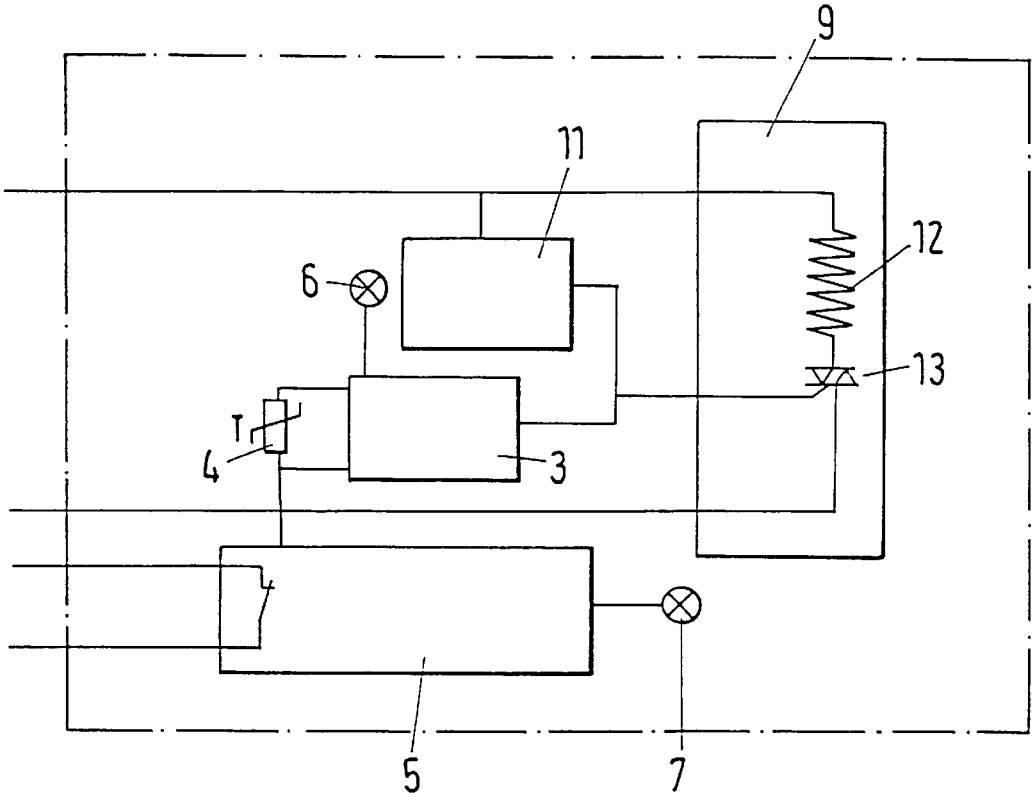
Figure 5:
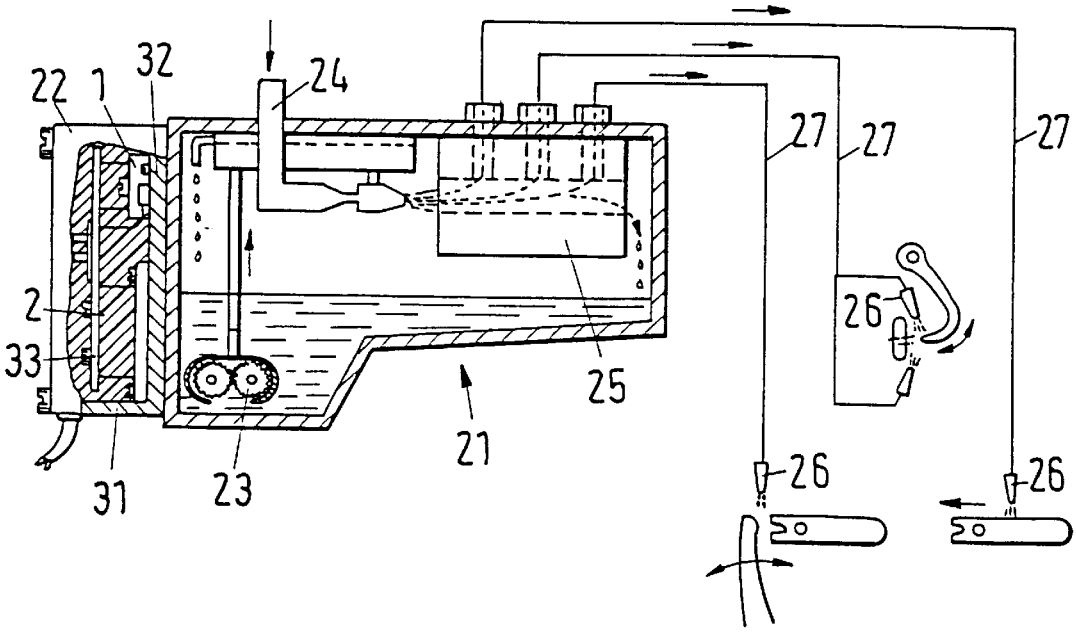
Figure 6:
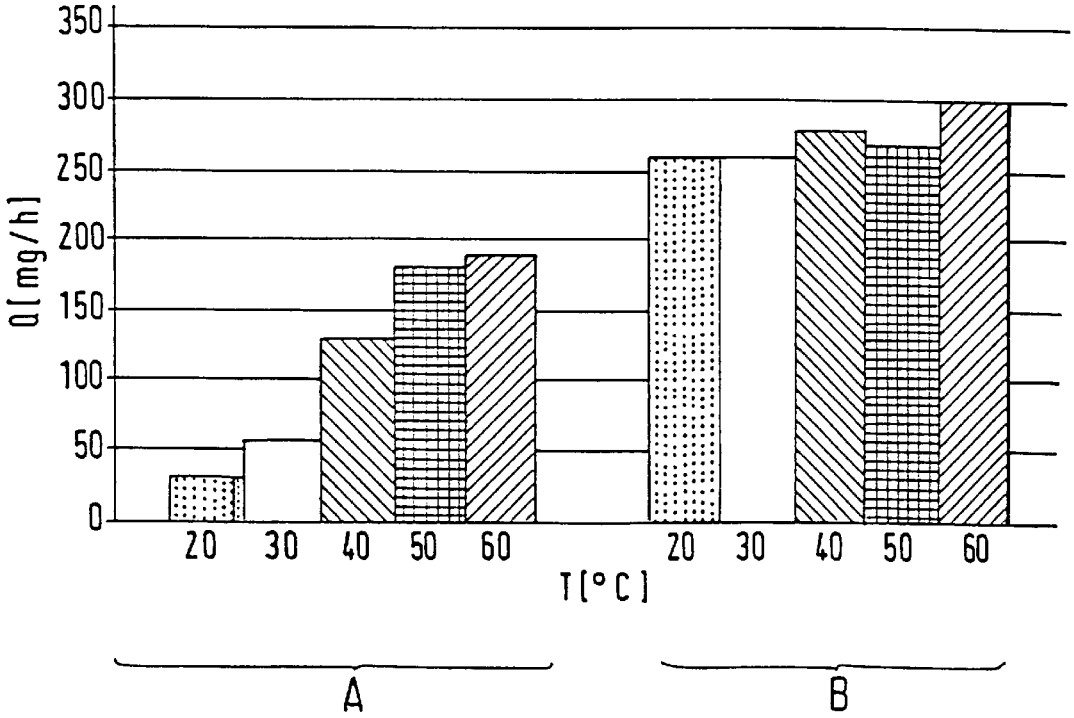

There are shown:

FIG. 1 a schematic block diagram of an embodiment of an apparatus in accordance with the invention;

FIG. 2 a schematic block diagram of another embodiment of an apparatus in accordance with the invention;

FIG. 3 a schematic block diagram of a modified embodiment of the apparatus of the invention in accordance with FIG. 2;

FIG. 4 a schematic block diagram of a further embodiment of an apparatus in accordance with the invention;

FIG. 5 a section through an apparatus for the lubrication of a plurality of lubrication points; and FIG. 6 a diagram of the quantity of lubricating oil in dependence on the temperature for a known apparatus and for an apparatus in accordance with the invention.

As shown in FIG. 1, the apparatus contains a bridge rectifier 1 for the voltage supply, a heating element 2, a temperature regulator 3 with a sensor 4 and a monitoring unit 5. The bridge rectifier is connected to the heating element 2 and to the temperature regulator 3. The heating element is formed as a switching circuit with two transistors.

The embodiments of the temperature regulator 3 and of the monitoring unit 5 are known, with a plurality of limiting values being provided for the temperature. A light emitting diode 6 is provided which indicates the switched on state of the apparatus. A light emitting diode 7 is associated with the monitoring unit which signalises a fault of the apparatus and a switching element is integrated into the monitoring unit in order to effect a safety switch off.

The apparatus is operated with the operating voltage of the weaving machine, with the desired heating power being determined by the selected strength of,current.

The apparatus of FIG. 2 is distinguished from that of FIG. 1 in that a power regulator 11 is provided, with the desired heating power being adjustable. The current is automatically set as a result of the voltage and the temperature.

FIGS. 3 and 4 each show an apparatus with a modified heating element 8 and 9, which is provided with a heating resistance.

FIG. 5 shows a lubricating apparatus for a projectile weaving machine with, for example, three lubricating points. The lubricating apparatus contains an oil container 21 and an apparatus 22 for the heating up of the lubricating oil. The lubricating apparatus contains a pump 23, a mist generator 24 and a distributor 25 which are arranged in the container and also three nozzles 26 which are arranged at the lubricating points and are connected to the distributor 25 via supply lines 27. An apparatus of this from EP-A-0 502823.

The apparatus for the heating up of the lubricating oil contains a housing 31 which is, for example, open at one end, with a base part 32, an electronic circuit card 32, on which the circuit is built up. The power transistor 2 with the sheet metal cooling plate, the bridge rectifier 1 and also the temperature sensor 4 are secured to the base part 32. The housing 31 is secured to the base part 32 on the oil container 21 and a heat conducting paste is provided between the contacting surfaces in order to improve the thermally conductive transmission. The hollow cavities of the housing are preferably potted in order to prevent damage due to vibrations.

By switching on the apparatus, a voltage is applied to the transistors. The loss energy which arises is converted into heat and must be led away by cooling. For this the transistors with the sheet metal cooling plate are secured to the base part so that the heat is conducted via the base part through the wall of the oil containers 21 into the lubricating oil.

Through the apparatus the heating up of the lubricating oil is improved, as is evident from FIG. 6. FIG. 6 shows the dependency between the heating up and the quantity of oil in the known apparatus with a PTC semiconductor A and with the apparatus of the invention with transistors B. The lack of lubrication (A) which arises with the weaving machine in the cold state is largely overcome. Through the short warm up time a weaving machine is ready for operation earlier so that the heating up of the lubricating oil and the direct environment, i.e. the lubricating oil container and lubrication oil lines is independent of the degree of heating up of the loom itself.

The apparatus contains at least one heating element 2 with at least one semiconductor and a temperature regulator 3 with a sensor 4. The apparatus is used for the heating up of lubricating oil.

The advantage is that the loss energy of the semiconductor is used as operating energy for the heating up of the lubricating oil.

What is claimed is:

1. An apparatus for the heating of lubricating oil for a weaving machine, the lubricating oil being present in a container, and the apparatus containing at least one heating element and a temperature controller with a sensor, wherein the apparatus further comprises a housing of a material with good thermal conductivity and the heating element and the temperature controller with the sensor are so arranged in the housing that the heating element is thermally conductingly connected to a housing wall, and wherein the container consists of a material with good thermal conductivity and the housing is secured to the outer surface of the container, with a means for thermal conduction being provided between the contacting surfaces for conducting heat through the wall of the container into the lubricating oil.

2. Apparatus in accordance with claim 1, wherein the heating element is a current or voltage controlled semiconductor device.

3. Apparatus in accordance with claim 1, wherein the heating element is a current controlled semiconductor device and has a heating resistor.

4. Apparatus in accordance with claim 1, further comprising a monitoring unit which is connected to the sensor of the temperature regulator.

5. Apparatus in accordance with claim 1, further comprising a bridge rectifier for the voltage supply, with the bridge rectifier as a protection against incorrect polarity enabling operation with DC current and also AC current.

6. Apparats in accordance with claim 1, wherein a power regulator is provided.

7. Apparatus in accordance with claim 1, further comprising a bridge rectifier and a monitoring unit which is connected to the sensor of the temperature regulator, wherein the bridge rectifier, the heating element, the temperature regulator with the sensor and monitoring unit are formed as a unit.

* * * * *